US005279509A

United States Patent [19]

Gifford

[11] Patent Number: 5,279,509

[45] Date of Patent: Jan. 18, 1994

[54] MARINE SURFACE DRIVE

[76] Inventor: William J. Gifford, 335 W. Moss Mill Rd., Egg Harbor City, N.J. 08215

[21] Appl. No.: 701

[22] Filed: Jan. 5, 1993

[51] Int. Cl.[5] ..... B63H 5/12

[52] U.S. Cl. ..... 440/51; 440/61

[58] Field of Search ..... 440/61, 65, 51, 43, 440/53, 58-60

[56] References Cited

U.S. PATENT DOCUMENTS

| | | | |
|---|---|---|---|
| 2,076,603 | 4/1937 | Svendsen | 440/51 |
| 2,956,536 | 10/1960 | Kilvington | 115/35 |
| 2,961,988 | 11/1960 | Wood | 440/65 |
| 2,999,476 | 9/1961 | Johnson | 115/35 |
| 3,253,569 | 5/1966 | Serdar | 115/35 |
| 3,933,116 | 1/1976 | Adams et al. | 440/61 X |
| 4,089,289 | 5/1978 | Sauder | 115/41 |
| 4,382,796 | 5/1983 | Blanchard | 440/51 |
| 4,403,969 | 9/1983 | Pichl | 440/56 |
| 4,432,737 | 2/1984 | Johansson | 440/60 |
| 4,544,362 | 10/1985 | Arneson | 440/61 |

*Primary Examiner*—Sherman Basinger

*Attorney, Agent, or Firm*—Jacobson, Price, Holman & Stern

[57] ABSTRACT

A surface drive is provided mounted from the stern of a hull for up and down swinging movement in the manner of an outdrive unit, but wherein the surface drive includes a forwardly and upwardly inclined propeller shaft with a forward extension thereof coupled, through the utilization of a universal joint, to the rear end of a power shaft journaled through and projecting rearwardly of the transom of the associated hull and with which the propeller is generally aligned, the surface drive being laterally stabilized and including an upstanding rudder oscillatably supported therefrom rearward of the surface drive propeller.

8 Claims, 2 Drawing Sheets

MARINE SURFACE DRIVE

BACKGROUND OF THE INVENTION

1. Field of the Invention

This invention relates to a marine surface drive unit of the type utilizing an inboard engine driving a propeller disposed rearward of the transom of an associated boat hull and at an elevation such that the water level immediately rearward of the hull transom, during high speed operation of the hull, is generally registered with the center of the hub portion of the propeller, the propeller and an oscillatable rudder disposed rearward thereof being mounted from a front to rear extending support arm mounted from the transom for up and down oscillation of the rear end thereof, the rudder being carried by the support arm rear end and the propeller being journaled from a depending strut carried by the support arm forward of the rear end thereof.

2. Description of Related Art

Various different forms of outdrive-type boat propulsion systems including some of the general structural and operational features of the instant invention here-tofore have been provided. Examples of these previous known propulsion systems are disclosed in U.S. Pat. Nos. 2,956,536, 2,999,476, 3,253,569, 4,089,289, 4,382,796, 4,403,969 and 4,432,737. However, these previously known propulsion systems do not comprise surface drive propulsion systems, nor do they offer the convenience of a vertically raiseable and lowerable marine propeller propulsion system incorporating an inboard engine and devoid of gearing exteriorly of the associated hull.

SUMMARY OF THE INVENTION

The main object of this invention is to provide a marine surface drive which will enjoy a high maximum horsepower rating.

Another object of this invention is to provide a marine surface drive having a cost factor which is only a fraction of the cost factor of more popular present day marine surface drives.

Still another important object of this invention is to provide a marine surface drive in accordance with the preceding objects and which incorporates a laterally stabilized propeller shaft in conjunction with a pivotal rudder.

Another object of this invention is to provide a marine surface drive which is devoid of gearing externally of the associated hull.

Still another object of this invention is to provide a marine surface drive incorporating a minimum of parts in the actual power train thereof so as to not only reduce initial cost but also considerably reduce part failure and maintenance costs.

A final object of this invention to be specifically enumerated herein is to provide a marine surface drive in accordance with the preceding objects and which will conform to conventional forms of manufacture, being of simple construction and efficient in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
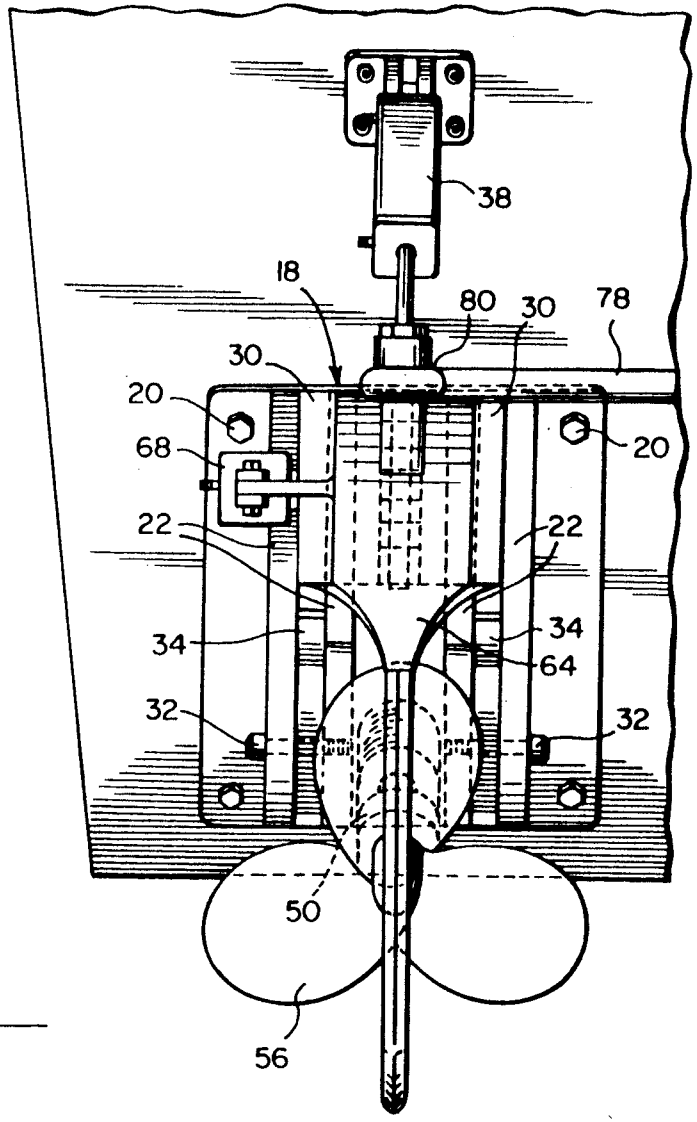
FIG. 3 is a rear elevational view of the assemblage illustrated in FIG. 2.

Referring now more specifically to the drawings, the numeral 10 generally designates a boat hull including a rearwardly facing upstanding surface 12 comprising a transom. The hull includes an inboard engine (not shown) driving a power shaft 14 having a rear end portion journaled through a lower portion of the transom 12 as at 16 in a water tight manner.

The shaft 14 is rearwardly and downwardly inclined and a heavy duty pivot mount assembly referred to in general by the reference numeral 18 is mounted to the transom 12 through the utilization of suitable fasteners 20, the assembly 18 including four upstanding, parallel and rearwardly projecting first mounting flanges 22.

A generally horizontal, front-to-rear extending support arm referred to in general by the reference numeral 24 includes front and rear ends 26 and 28 and the front end 26 includes two laterally spaced apart, upstanding second mounting flanges 30 interdigitated with the mounting flanges 22 and pivotally supported therefrom through the utilization of a pair of aligned heavy duty pivot shafts 32, the mounting flanges 22 having stopper blocks 34 supported therefrom and the mounting flanges 30 being engageable with the stopper blocks 34 to limit downward swinging movement of the rear end 28 of the support arm 24.

Figure 1:
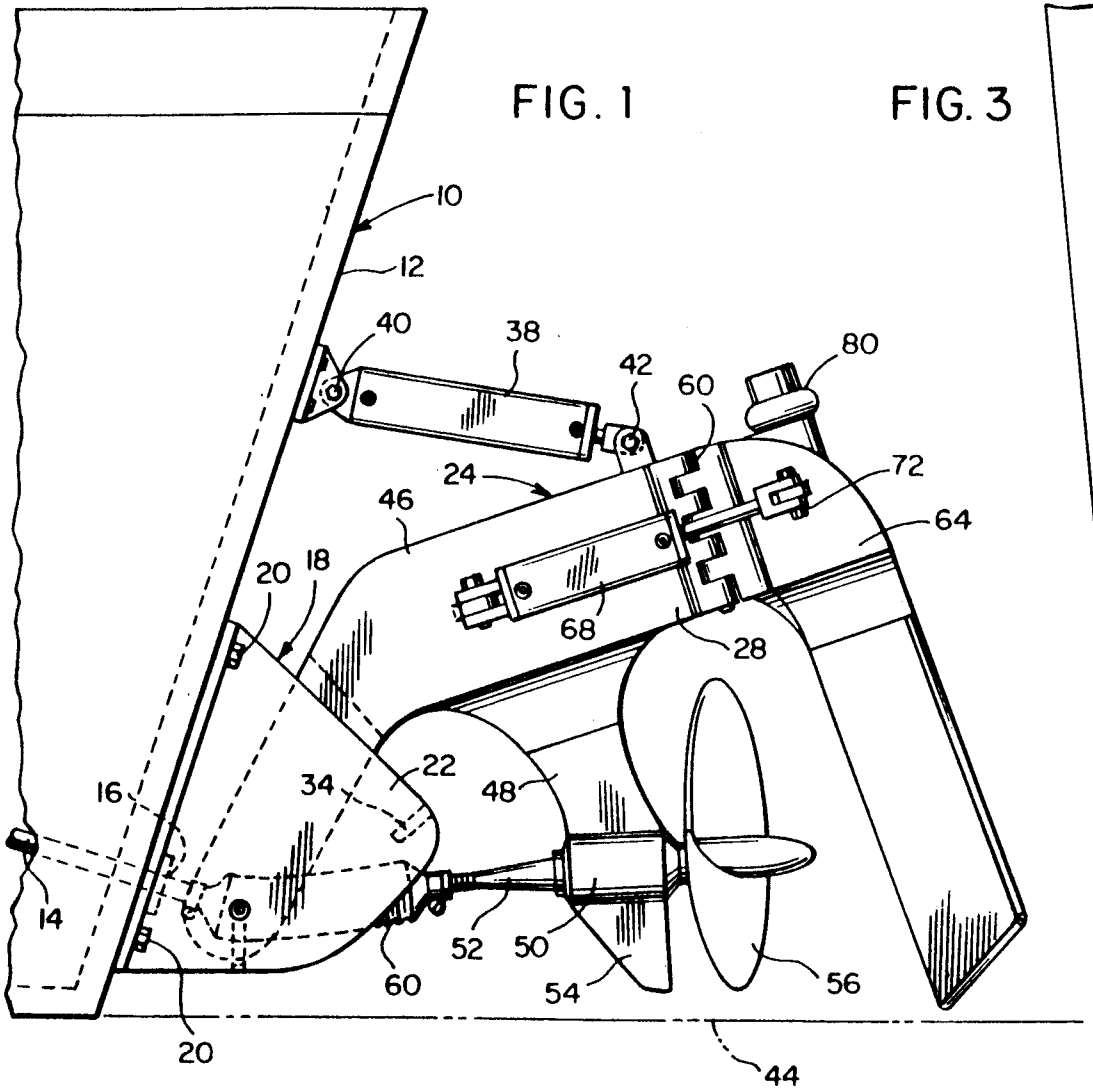
FIG. 1 is a side elevational view of a marine surface drive constructed in accordance with the present invention with the outboard portion of the drive in a raised position fully above the approximate water level disposed immediately rearward of the transom of the associated hull when the hull is moving at high speed.

A fluid cylinder 38 of the double acting type is pivotally mounted from the transom 12 as at 40 and the rear end 28 of the support arm 24 as at 42 and may be selectively operated in any convenient manner to upwardly swing the rear end 28 of the support arm 24 approximately 25° to the position thereof illustrated in FIG. 1 with the entire support arm 24 spaced above the approximate water level 44 when the hull 10 is traveling forward at speed.

The intermediate length portion 46 of the support arm 24 includes a depending strut 48 whose lower end portion defines a hub 50 through which a propeller shaft 52 is journaled, a skeg 54 projecting downward below the hub 50. A surface piercing propeller 56 is mounted on the propeller shaft 52 rearward of the hub 50 and the forward end of the propeller shaft 52 includes a slip coupling 56 which is in turn driven by the power shaft 14 through the utilization of a universal joint 58.

Figure 2:
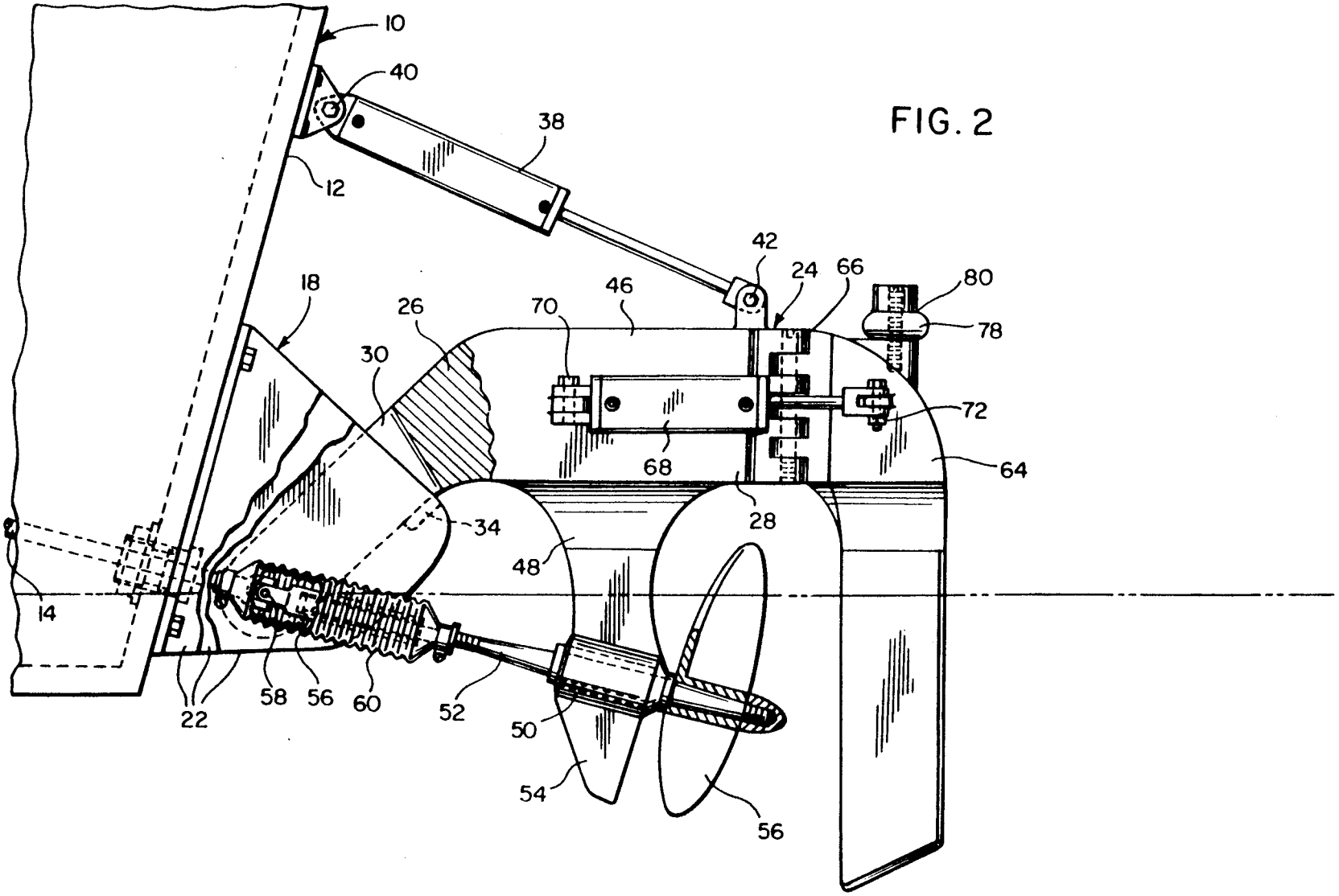
FIG. 2 is a side elevational view similar to FIG. 1 but with the outboard portion of the marine surface drive in a fully lowered operative position, portions of the drive train and propeller of the drive being broke away and illustrated in vertical section.

Although a nonconstant velocity universal joint 58 has been illustrated, it is to be noted that a constant velocity universal joint may be used. Further, the number of flanges 22 and 30 may be varied and structure other than the fluid cylinder or motor 38 may be used to adjustably position the support arm 24 between the positions thereof illustrated in FIGS. 1 and 2. Still further, the spacing between the central mounting flanges 22 is appreciable to enable the pair of coaxial pivot 32 shafts to be used on either side of the shaft 14 with the pivot axes thereof passing through the center of the universal joint 58, thus eliminating the need for the slip coupling 56, if desired. Further, a protective boot 60 is disposed about the universal joint 58 and slip coupling 56 (when provided) with its opposite ends supported from the shaft 14 and 52. However, since the pivot axis for the support arm 24 is registered with the universal joint 58, a considerably shorter boot 60 may be utilized if the slip coupling 56 is eliminated since the boot 60 will need to enclose only the universal joint 58.

The rear end 28 of the support arm 24 includes a depending rudder 64 supported therefrom and pivotally mounted from the support arm 24 by a heavy duty hinge assembly 66. In addition, a fluid motor 68 is pivotally mounted from the support arm 24 as at 70 and the rudder 64 as at 72 and may be utilized to adjustably angularly displace the rudder 64 relative to the support arm 24, the assemblage illustrated in FIGS. 1-3 comprising a port propulsion system mounted on the transom 12 and an adjustable length transverse tie bar 78 having one end pivotally attached to the upper portion of the rudder 64 as at 80 and its other end pivotally attached to the upper end of the rudder of a corresponding starboard propulsion system (not shown) mounted from the hull 10. Thus, only one of the propulsion systems need be provided with a fluid motor 68.

It also will be noted that the propeller shaft may have a second propeller (not shown) mounted thereon immediately forward of the hub 50 and the hub 50 may, or may not, include meshed bevel gears drivingly connecting separate front and rear sections of the shaft 52 for simultaneous, equal and opposite rotation, such counter rotating propeller structure being disclosed in my copending U.S. Ser. No. 07/988,872, now U.S. Pat. No. 5,232,386 for Counter Rotating Strut Drive, filed Dec. 10, 1992 and incorporated herein by reference thereto.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalence may be resorted to, falling within the scope of the invention.

What is claimed as new is as follows:

1. In combination, a marine hull including an upstanding rear facing surface with at least a lower portion of said surface disposed below the at rest water line of said hull and including a power shaft journaled therethrough above the lower terminus of said surface, a support arm including front and rear ends, mounting means including pairs of first laterally spaced apart, rearwardly projecting and upstanding first mounting flanges rigidly mounted from and projecting rearwardly of said rear facing surface on opposite sides of said power shaft, said front end of said support arm including forwardly and downwardly inclined second mounting flanges disposed on opposite sides of said power shaft interdigitated with and pivotally supported from said pairs of first mounting flanges for up and down swinging of the rear end of said support arm relative to said hull about a first axis transverse to said hull between raised and lowered positions, respectively, said support arm including a depending strut rearward of said second mounting flanges, a propeller shaft journaled from said strut and at least generally aligned with said power shaft when said arm is in said lowered position, a propeller mounted on said propeller shaft, drive connection means drivingly coupling said power shaft to said propeller shaft, adjustment means operative to swing said arm between said raised and lowered positions, said rear end of said arm including depending rudder means disposed rearward of said strut and said propeller and mounted from said rear end for angular displacement about an upstanding axis, rudder control means operatively connected between said arm and rudder means for adjustably angularly displacing said rudder means relative to said hull, said first mounting flanges including rear portions spaced appreciably rearward of said first axis, stopper blocks extending between and interconnecting said rear portions of said pairs of first mounting flanges, said stopper blocks being engagable by said second mounting flanges to limit downward swinging of the rear end of said support arm to said lowered position, said drive connection means including a universal joint through which said first axis extends.

2. The combination of claim 1 wherein said upstanding rear facing surface comprising the rear surface of a transom portion of said hull.

3. The combination of claim 1 wherein said adjustment means comprises a rearwardly and downwardly inclined double acting fluid cylinder connected between said surface and said rear end of said arm.

4. The combination of claim 1 wherein said rudder control means includes a double acting fluid cylinder operatively connected between said arm and rudder.

5. The combination of claim 1 including a protective boot enclosing said universal joint.

6. In combination, a marine hull including an upstanding rear facing surface with at least a lower portion of said surface disposed below the at rest water line of said hull and including a power shaft journaled therethrough above the lower terminus of said surface, a support arm including front and rear ends, mounting means including pairs of first laterally space apart, rearwardly projecting and upstanding mounting flanges rigidly mounted from said rear facing surface on opposite sides of said power shaft, said front end of said support arm including laterally spaced forwardly and downwardly inclined second mounting flanges disposed on opposite sides of said power shaft and interdigitated with and pivotally supported from said pairs of first mounting flanges, said arm including a depending strut rearward of said second mounting flanges, a propeller shaft journaled from said strut, a propeller mounted on said propeller shaft, drive connection means drivingly coupling said power shaft to said propeller shaft, the rear end of said arm including depending rudder means disposed rearward of said strut and propeller and mounted from said rear end for angular displacement about an upstanding axis, rudder control means operatively connected between said arm and rudder means for adjustably angularly displacing the latter relative to said hull, said first mounting flanges including rear portions, stopper blocks extending between and interconnecting said rear portions of said pairs of first mounting flanges, said stopper blocks being engagable by said second mounting flanges to limit downward swinging of the rear end of said support arm, said drive connection means including a universal joint.

7. The combination of claim 6 wherein said upstanding rear facing surface comprising the rear surface of a transom portion of said hull.

8. The combination of claim 6 wherein said rudder control means includes a double acting fluid cylinder operatively connected between said arm and rudder.

* * * * *